United States Patent [19]

Sone et al.

[11] Patent Number: 5,030,377

[45] Date of Patent: Jul. 9, 1991

[54] DETERGENT COMPOSITIONS CONTAINING STARCH DEBRANCHING ENZYMES

[75] Inventors: Taeko Sone; Hiroyuki Saijo; Katsuhiko Deguchi, all of Tochigi, Japan

[73] Assignee: Kao Corporation, Tokyo, Japan

[21] Appl. No.: 434,000

[22] Filed: Nov. 9, 1989

[30] Foreign Application Priority Data

Nov. 11, 1988 [JP] Japan ..... 63-285424
Nov. 11, 1988 [JP] Japan ..... 63-285425
Nov. 11, 1988 [JP] Japan ..... 63-285426

[51] Int. Cl.[5] ..... C11D 3/386; C11D 7/42; D06M 16/00

[52] U.S. Cl. ..... 252/174.12; 252/174.19; 252/DIG. 12; 435/264

[58] Field of Search ..... 252/174.12–174.19, 252/DIG. 12; 435/264, 210

[56] References Cited

U.S. PATENT DOCUMENTS

| | | | |
|---|---|---|---|
| 3,922,196 | 11/1975 | Leach et al. | 195/31 R |
| 4,113,509 | 9/1978 | Leach et al. | 127/29 |
| 4,162,987 | 7/1979 | Maquire, Jr. et al. | 252/135 |
| 4,285,738 | 8/1981 | Ogata | 134/26 |
| 4,628,031 | 12/1986 | Zeikus et al. | 435/205 |
| 4,710,313 | 12/1987 | Miyajima et al. | 252/105 |
| 4,836,946 | 6/1989 | Dixit | 252/97 |
| 4,870,059 | 9/1989 | Mitsuhashi et al. | 514/53 |

*Primary Examiner*—Paul Lieberman
*Assistant Examiner*—A. Beadles-Hay
*Attorney, Agent, or Firm*—Birch, Stewart, Kolasch & Birch

[57] ABSTRACT

A detergent composition which comprises
(a) at least one surfactant and
(b) at least one starch debranching enzyme selected from the group consisting of pullulanase, isopullulanase and isoamylase, is disclosed.

The detergent composition of the invention may further contain α-amylase, as component (c).

The detergent composition of the invention shows significantly improved starchy dirt detergency.

9 Claims, No Drawings

DETERGENT COMPOSITIONS CONTAINING STARCH DEBRANCHING ENZYMES

FIELD OF THE INVENTION

This invention relates to a detergent composition which contains a starch debranching enzyme.

BACKGROUND OF THE INVENTION

It is already a conventional practice to incorporate enzymes into detergent compositions. Enzymes in detergent compositions serve as auxiliary detergents or washing promoters. Thus, for example, enzymes in laundry detergent compositions decompose or denature various kinds of dirt (or soil) and stains adhering to clothes, and enzymes in dishwashing detergent compositions decompose or denature fats and oils, proteins, starch and the like remaining on the dishware surface, to thereby facilitate and promote removal of various kinds of dirt. For the removal of starchy dirt, in particular, α-amylase has been used so far. Enhanced detergency can be attained by immersing articles to be washed in an α-amylase-containing washing solution for a prolonged period of time. However, α-amylase can hardly function to a satisfactory extent within an ordinary washing time of 5 to 30 minutes.

To keep abreast with the recent rapid spread of automatic dishwashers not only among restaurants and other commercial facilities but also among homes, detergent compositions for use in automatic-dishwashing have been developed. Thus, for example, automatic-dishwashing detergent compositions, which are available on the market in the powder form and constitute a typical class among dishwashing detergent compositions, comprise, as major components, inorganic alkaline substances or builders, such as pyrophosphates, tripolyphosphates, orthophosphates, carbonates, bicarbonates, sesquicarbonates, silicates and borates, and, as minor components, surfactants or lipase for enhancing fatty or oily dirt detergency, α-amylase for enhancing starchy dirt detergency, protease for enhancing proteinaceous dirt detergency, bleaching agents for enhanching pigment stain (e.g., tea stain) detergency, and so forth, as necessary or as desired. In automatic-dishwashing detergent compositions in the liquid form, surfactants are the major components, with enzymes and other ingredients added in small amounts.

Incorporation of α-amylase and the like enzymes into automatic-dishwashing detergent compositions, however, still cannot result in satisfactory removal of starchy dirt firmly adhering to dishware within a short period of time. Improvements are desired.

SUMMARY OF THE INVENTION

Thus the invention provides a detergent composition which comprises:

(a) at least one surfactant and (b) at least one starch debranching enzyme selected from the group consisting of pullulanase, isopullulanase and isoamylase.

The detergent composition of the invention preferably further contains α-amylase as component (c).

DETAILED DESCRIPTION OF THE INVENTION

The detergent composition of the invention contains .the component (a), namely at least one surfactant, preferably in an amount of 0.5 to 60% by weight based on the composition although the content of component (a) is not limited to any particular level or range.

Surfactants which can be used as component (a) in the detergent composition of the invention include:

anionic surfactants such as alkylbenzenesulfonic acid salts, alkyl or alkenyl ether sulfate salts, alkyl or alkenyl sulfate salts, olefinsulfonic acid salts, alkenesulfonic acid salts, saturated or unsaturated fatty acid salts, alkyl or alkenyl ether carboxylic acid salts, α-sulfo fatty acid salts or esters, amino acid type surfactants, N-acyl amino acid type surfactants, alkyl or alkenyl acid phosphate esters or salts thereof;

amphoteric surfactants such as carboxy- or sulfobetaine type surfactants;

Nonionic surfactants such as polyoxyalkylene alkyl or alkenyl ethers, polyoxyethylene alkylphenyl ethers, higher fatty acid alkanolamides or alkylene oxide adducts derived therefrom, sucrose fatty acid esters, fatty acid glycerin monoesters and alkylamine oxides; and cationic surfactants such as quaternary ammonium salts.

When the detergent composition of the invention is to be used as an automatic-dishwashing detergent composition, as the component (a), namely at least one surfactant, a low-foaming or nonfoaming nonionic surfactants are preferred.

Examples of such type of surfactant include alkoxylated nonionic surfactants (ethoxylated with ethylene oxide (EO), propoxylated with propylene oxide or mixed ethoxylated and propoxylated). Preferred examples of such surfactants are PLURAFAC® LF403 (manufactured by BASF Japan), PLURAFAC® LF1300 (manufactured by BASF Japan) and SOFTANOL® EP7045 (manufactured by Nippon Shokubai Kagaku Kogyo Co., Ltd.).

For use the detergent composition of the invention as an automatic-dishwashing detergent composition, the surfactant is contained in an amount of preferably 0.5 to 30% by weight based on the composition.

The component (b), namely starch debranching enzyme to be used in the composition of the invention, can be obtained from various sources. Generally, however, it is derived from microorganisms. Preferred species of the starch debranching enzyme are pullulanase, isopullulanase and isoamylase, which show amylopectin 6-glucanohydrolase activity, derived from, for example, microbial strains belonging to the genus Klebsiella, Bacillus, Asperqillus or Pseudomonas.

These enzymes are commercially obtainable and examples thereof include SPLENTASE® (manufactured by Amano Pharmaceutical Co., Ltd.) and PROMOZYME® 200L (manufactured by Novo Industri A/S), as for pullulanase; and "isoamylase" (reagent, manufactured by Seikagaku Kogyo Co., Ltd.), as for isoamylase. Such starch debranching enzymes are supplied generally in the form of granules and have an enzymatic activity of about $10^5$ to $10^8$ units per liter.

The starch debranching enzyme is contained in the detergent composition of the invention in an amount of preferably 0.01 to 10% by weight, more preferably 0.01 to 5% by weight.

In order to improve detergency for starchy dirt, the detergent composition of the invention may preferably contain α-amylase, in addition to the above-mentioned essential components (a) and (b), as component (c).

α-Amylase, which is to be added as optional component (c) to the detergent composition of the invention, is an enzyme so far used in detergent compositions and any species thereof may be used. Among them, α-amylase derived from *Bacillus licheniformis* or *Bacillus subtilis* are preferred, and the enzymes can be obtained as commercial products under the name of, for example, TERMAMYL® (manufactured by Novo Industri A/S) and MAXAMYL® (manufactured by Gist-Brocades).

When α-amylase is additionally used in the detergent composition of the invention, starch debranching enzyme and α-amylase are contained in the composition in an amount to satisfy the relation such that an activity ratio (starch debranching enzyme activity/α-amylase activity ratio) is in the range of preferably $1/10^3$ to $10^8/1$, more preferably 1/10 to $10^2/1$, as determined by the DNS (3,5-dinitrosalicylic acid) method. The total content of starch debranching enzyme and α-amylase in the detergent composition of the invention generally amounts to 0.1 to 10% by weight, preferably 0.1 to 5% by weight.

In washing operations using the detergent composition of the invention, it is preferable to use the composition in such an amount that the washing solution contains the starch debranching enzyme and α-amylase each in an amount of not less than 4 units per liter as expressed in terms of enzymatic activity. Each unit (U) of enzymatic activity is defined as the amount of enzyme sufficient to form 1 micromole (μmol) of glucose per minute.

For enzymatic activity measurements, the following methods are used.

1) Starch debranching enzyme activity

Substrate: 0.5% (by weight) pullulan solution.

Preparation of substrate solution:

Pullulan (0.5 g) is dissolved in 90 ml of deionized water, and 5 ml of 1 M Tris-HCl buffer (pH 5.9) are added thereto, and then the volume is made 100 ml with deionized water.

Testing of samples:

The substrate solution (0.5 ml) is placed in a test tube, 0.4 ml of the buffer and 0.1 ml of an adequately diluted enzyme solution are added and the reaction is allowed to proceed in a constant-temperature bath maintained at 40° C., for 30 minutes. Then, 1 ml of DNS test solution is added and the test tube contents are heated in boiling water exactly for 5 minutes for color development. Then, the tube is immediately cooled in an ice water bath. After cooling, 4 ml of deionized water is added and, after thorough mixing, the absorbance at 535 nm is measured quickly.

Blank testing:

The substrate (0.5 ml) and 0.4 ml of the buffer are placed in a test tube, followed by addition of 1.0 ml of DNS test solution. Furthermore, 0.1 ml of the adequately diluted enzyme solution is added and the test tube is put in boiling water immediately and heated therein exactly for 5 minutes for color development. Then the tube is immediately cooled in an ice water bath. After cooling, 4 ml of deionized water is added and, after thorough mixing, the absorbance at 535 nm is measured quickly.

Calibration curve construction:

The substrate solution is distributed in 0.5 ml portions and the buffer in 0.4 ml portions into test tubes. Then, glucose solutions for calibration are added each in an amount of 0.1 ml so as to give glucose concentrations of 250 to 1,500 μmol/liter. Furthermore, 1.0 ml of DNS test solution is added to each tube. The subsequent procedure is the same as in testing of samples. After plotting the data thus obtained (abscissa for glucose concentration and ordinate for absorbance), the gradient (slope) of the resulting curve is determined and the conversion factor (F) is calculated as follows:

$$F = \frac{1}{\text{Gradient}} \times \frac{1}{30} \times \frac{1}{0.1}$$

Activity calculation:

The enzymatic activity is calculated by the following equation:

$$\text{Activity (U/liter)} = \delta \text{ absorbance} \times F \times \text{Dilution factor}$$

where δ absorbance=(absorbance for sample)−(absorbance for blank).

2) α-Amylase activity

Substrate:

0.5% by weight solution of soluble starch (manufactured by Merck Inc.).

Preparation of substrate solution:

Soluble starch (0.5 g) is dissolved in 90 ml of deionized water, 5 ml of 1 M Tris-HCl buffer (pH 5.9) are added and the volume is then made 100 ml with deionized water.

Testing of samples:

The substrate solution (0.9 ml) is placed in a test tube, followed by addition of 0.1 ml of an adequately diluted enzyme solution. The reaction is then allowed to proceed in a constant-temperature bath maintained at 50° C. for 15 minutes. Then, 1 ml of DNS test solution is added and the test tube contents are heated in boiling water exactly for 5 minutes for color development and then immediately cooled in an ice water bath. After cooling, 4 ml of deionized water is added and, after thorough mixing, the absorbance at 535 nm is measured quickly.

Blank testing:

The substrate solution (0.9 ml) is placed in a test tube and then 1.0 ml of DNS test solution is added. Furthermore, 0.1 ml of the adequately diluted enzyme solution is added. The test tube is quickly put in boiling water and heated therein exactly for 5 minutes for color development. After immediate cooling in an ice water bath, 4 ml of deionized water is added and, after thorough mixing, the absorbance at 535 nm is measured quickly.

Calibration curve construction:

The substrate solution is distributed in 0.9-ml portions into test tubes. Glucose solutions for calibration are then added each in an amount of 0.1 ml so as to give glucose concentrations of 250 to 1,500 μmol/liter. Furthermore, 1.0 ml of DNS test solution is added to each tube. The subsequent procedure is the same as in testing of samples. The data thus obtained are plotted (abscissa for glucose concentration, ordinate for absorbance) and the gradient is determined. The conversion curve (F) is determined as follows:

$$F = \frac{1}{\text{Gradient}} \times \frac{1}{15} \times \frac{1}{0.1}$$

Activity calculation:

The activity is calculated as follows:

Activity (U/liter) = δabsorbance × $F$ × Dilution factor where δabsorbance = (absorbance for sample) − (absorbance for blank).

Preparation of 3,5-dinitrosalicylic acid (DNS) test solution (1 liter):

Sodium hydroxide (16 g) is dissolved in 200 ml of deionized water. To the solution is added portionwise 5 g of DNS. After complete dissolution of DNS, 300 g of potassium sodium tartrate are added. After complete dissolution of potassium sodium tartrate, the volume is made 1,000 ml with deionized water.

The detergent composition of the invention may contain other ingredients generally incorporated in conventional detergent compositions depending on the intended use of the detergent composition without any particular limitations. Such ingredients are described below.

(1) Alkaline substances such as carbonates, bicarbonates, silicates, borates and alkanolamine salts; or inorganic electrolytes such as sulfates, are incorporated in the composition generally in an amount of 0 to 90% by weight.

(2) Divalent metal ions sequestering agents, for example, phosphates such as tripolyphosphates, pyrophosphates and orthophosphates; phosphonates such as ethane-1,1-diphosphonates; phosphonocarboxylates such as 2-phosphonobutane-1,2-dicarboxylates; amino acid salts such as aspartates and glutamates; aminopolyacetates such as nitrilotriacetates and ethylenediaminetetraacetates; high molecular chelating agents such as polyacrylic acid and polyaconitic acid; organic acid salts such as oxalates and citrates; and aluminosilicates, are incorporated in the composition generally in an amount of 0 to 50% by weight.

(3) Bleaching agents such as sodium percarbonate, sodium perborate, sodium hypochlorite and dichloroisocyanuric acid, and incorporated into the composition generally in an amount of 0 to 85% by weight.

(4) Other minor components, which may optionally be incorporated in the composition as necessary, include antiredeposition agents such as polyethylene glycol and carboxymethylcellulose; enzymes, such protease lipase and cellulase; enzyme deactivation inhibitors such as sulfites; fluorescent whitening agents (or optical brighteners); bluing agents; colorants; caking inhibitors; solubilizing agents; activators for enzymes or bleaching agents; corrosion inhibitors and so forth.

For use in automatic-dishwashers, the detergent composition of the invention, when it is in the powder form, should contain, in addition to the essential components mentioned above, at least one inorganic alkaline substance selected from among sodium pyrophosphate, sodium orthophosphate, sodium tripolyphosphate, sodium carbonate, sodium bicarbonate, sodium sesquicarbonate, borax, sodium silicate, etc. It is preferable to use sodium silicate in combination with one or more other alkaline substances since sodium silicate has corrosion inhibitor activity. The combined use of 2 to 15% by weight of sodium silicate ($SiO_2/Na_2O$ ratio being 1/1 to 4/1, preferably 2/1 to 2.5/1) and 35 to 85% by weight of one or more other alkaline substances is most preferred. The total inorganic alkaline substance content should be adjusted so that the washing solution, when it contains the detergent composition in a concentration of 0.05 to 1% by weight, may have a pH of 9.0 to 11.0. In the case of liquid detergent composition, water accounts for the balance.

In view of the current trend towards phosphate-free detergents to avoid or solve environmental or eutrophication problems, it may become important to formulate phosphate-free compositions for machine dishwashing with the spread of automatic-dishwashers, without any significant decrease in detergency towards various kinds of dirt. In formulating such phosphate-free detergent compositions, it is preferable to incorporate hydrogenpolycarboxylic acid represented by the formula (I) below, or water-soluble salts thereof, into the detergent composition of the invention as a divalent metal ions sequestering agent:

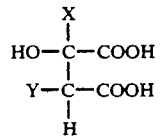

(I)

wherein X represents H, $—CH_3$, $—CH_2COOH$ or —CH(OH)COOH; and Y represents H or —OH.

Among the compounds represented by the above formula (I), citric acid, malic acid and tartaric acid are preferred. Examples of the water-soluble salts thereof include the sodium salt, potassium salt, monoethanolamine salt, diethanolamine salt and triethanolamine salt.

The detergent composition of the invention contains the hydrogenpolycarboxylic acid or water-soluble salts thereof in an amount of preferably 0.5 to 30% by weight.

Furthermore, it is preferable for formulating such phosphate-free detergent composition to use a high molecular chelating agent as a divalent metal ions sequestering agent in an amount of 1 to 10% by weight. As the high molecular chelating agent, a divalent metal ions sequestering polyelectrolyte as disclosed in JP-A-57-145199 (the term "JP-A" as used herein means an "unexamined published Japanese Patent Application") can be used, and examples thereof include polymers of acrylic acid or methacrylic acid, acrylic acid-methacrylic acid copolymers, and water-soluble salts of these. Their average molecular weights should preferably amount to 1,500 to 100,000, more preferably 3,000 to 20,000.

The automatic-dishwashing detergent composition of the invention may further contain conventional ingredients, for example proteolytic enzymes, bleaching agents such as dichloroisocyanuric acid, and copper corrosion inhibitors, if necessary.

Preferred example of the proteolytic enzyme which may be used in the composition of the invention is subtilisin, and it can be obtained from specific microbial strains belonging to the species *Bacillus subtilis* or *Bacillus licheniformis*. Subtilisin is obtainable as commercial products under the name of, for example, MAXATASE® (manufactured by Gist-Brocades), ALCALASE® (manufactured by Novo Industri A/S), ESPERASE® (manufactured by Novo Industri A/S) and SAVINASE® (manufactured by Novo Industri A/S).

It is also effective to add a fatty acid having a hydrocarbon chain length of about 8 to 18 or benzotriazole or the like as a copper corrosion inhibitor.

The detergent composition of the invention which contains the starch debranching enzyme specified herein show significantly improved starchy dirt detergency within an ordinary time of washing. Additional incorporation of a hydroxypolycarboxylic acid or a salt thereof markedly enhance not only starchy dirt detergency but also fatty or oily dirt detergency.

The following examples are further illustrative of the present invention but by no means limitative of the scope thereof. In the examples, unless otherwise specified, "%" means "% by weight" and the ratios given are weight ratios.

EXAMPLE 1

Automatic-Dishwashing Detergent Compositions

The washing conditions and detergency evaluation method used in this example and the results obtained are as follows:

1) Washing Conditions

Washer: Model NP-600 full-automatic dishwasher manufactured by Matsushita Electric Industrial Co., Ltd. In this model, an aqueous detergent solution ejected from a rotary nozzle means washes the dishes and the like positioned in the orbital plane of the nozzle means.

Washing temperature: The temperature is gradually raised from 5° C. up to 55° C.

Washing water: Water having a hardness of 3.5° DH.

Detergent concentration: 0.2% (enzyme activity in washing solution being 440 U/liter).

Washing time: Washing solution application 20 minutes, rinsing 20 minutes.

Amount of circulating washing solution: 2.5 liters.

2) Detergency Evaluation

Starchy Dirt-Carrying Plates

Rice-flour dumplings and cooked rice are mixed in a ratio of 9:1. An equal amount of tap water is added to the mixture and the whole is blended in a mixer. This dirt mixture (4 g) is uniformly applied to a ceramic plate having a diameter of 22 cm and air-dried for a whole day.

For each washing test run, 3 plates soiled in the above manner are used.

Evaluation Of Starchy Dirt Detergency

Residual starch is determined by color reaction with iodine followed by determination of the resulting blue-colored area ($P_1$) by a photograph. The detergency is calculated in comparison with the initial soiled surface area ($S_0$) by the following equation:

$$\text{Detergency (\%)} = ((S_0 - P_1)/S_0) \times 100$$

3) Detergent Composition Formulation

| | |
|---|---|
| SOFTANOL EP 7045 | 2 |
| Sodium citrate | 20 |
| Sodium silicate, grade No. 1 | 5 |
| Enzyme | See Table 1 |
| Sodium carbonate | Balance |

Note:
The numerical values are in % by weight.

4) Results Of Detergency Test

The results obtained are shown in Table 1 below, where Compositions Nos. 1 to 3 are of the present invention and Nos. 4 and 5 are for comparison.

TABLE 1

| | Composition No. | | | | |
|---|---|---|---|---|---|
| Enzymes | 1 | 2 | 3 | 4 | 5 |
| SPLENTASE[1] | 1.0 | | | | |
| PROMOZYME[2] | | 5.2 | | | |
| Isoamylase[3] | | | 0.02 | | |
| TERMAMYL 300L[4] | | | | 0.03 | |
| MAXAMYL WL[5] | | | | | 0.05 |
| Detergency (%) | 75 | 60 | 70 | 30 | 35 |

Notes:
[1]Pullulanase, manufactured by Amano Pharmaceutical Co., Ltd.; $6.1 \times 10^6$ U/liter.
[2]Pullulanase, manufactured by Novo Industri A/S; $4.5 \times 10^5$ U/liter.
[3]Isoamylase, manufactured by Seikagaku Kogyo Co., Ltd.; $5.9 \times 10^7$ U/liter.
[4]α-Amylase, manufactured by Novo Industri A/S; $4.4 \times 10^7$ U/liter.
[5]α-Amylase, manufactured by Gist-Brocades; $7.2 \times 10^6$ U/liter.

EXAMPLE 2

Laundry Detergent Compositions

The washing conditions and detergency test method used in this example and the results obtained are as follows:

1) Artificially Soiled Cloth

Rice-flour dumplings and cooked rice are combined in a ratio of 9:1. After two-fold dilution with tap water, the whole is blended in a mixer. The resulting mixture is applied to cotton cloth testpieces having a size of 10 cm×10 cm at a level of 2.5 to 5% based on the cloth weight. The thus-soiled cloths are dried at 20° C. for 24 hours and then tested.

2) Washing Conditions And Method

The detergent composition (in powder form) to be tested is dissolved in hard water (4° DH) to give 1 liter of a 0.665% aqueous detergent solution (enzymatic activity of washing solution $1.98 \times 10^3$ U/liter), Five artificially soiled cotton cloth testpieces are placed in the washing solution and, after 1-hour standing at 40° C., the washing solution and artificially soiled testpieces are transferred to a stainless steel beaker for a Terg-o-Tometer. Washing is performed in the Terg-O-Tometer at 20° C. for 10 minutes with stirring at 100 rpm. After rinsing with running water, the testpieces are dried at 20° C. for 24 hours and then weighed.

3) Detergency Evaluation

The detergency (%) is calculated based on the weight of the five cloth testpieces before soiling (original weight), their weight after soiling (weight before washing) and their weight after washing, by the following equation:

$$\text{Detergency (\%)} = \frac{\text{(Weight before washing)} - \text{(Weight after washing)}}{\text{(Weight before washing)} - \text{(Original weight)}} \times 100$$

The detergency values given in Table 2 each is the mean for five testpieces.

4) Detergent Composition Formulation

| | |
|---|---|
| Sodium n-dodecylbenzenesulfonate | 15 |
| Sodium alkylethoxylate sulfate ($C_{14}$-$C_{15}$, $\overline{EO}$ = 3 moles) | 5 |
| Type 4A zeolite | 15 |
| Sodium silicate | 15 |
| Sodium carbonate | 15 |
| Sodium polyacrylate ($\overline{MW}$ = 8,000) | 1.5 |

-continued

| | |
|---|---|
| Polyethylene glycol ($\overline{MW}$ = 6,000) | 1.5 |
| Enzyme | See Table 2 |
| Optical brightener | 0.5 |
| Sodium sulfate | Balance |
| Water | 5 |

Note:
The numerical value are in % by weight.

5) Detergency Test Results

The test results obtained are shown in Table 2, in which Compositions Nos. 1 to 3 are of the present invention and Nos. 4 and 5 are for comparison.

TABLE 2

| | Composition No. | | | | |
|---|---|---|---|---|---|
| Enzymes | 1 | 2 | 3 | 4 | 5 |
| SPLENTASE[1] | 1.8 | | | | |
| PROMOZYME[1] | | 9.4 | | | |
| Isoamylase[1] | | | 0.036 | | |
| TERMAMYL 300L[1] | | | | 0.054 | |
| MAXAMYL WL[1] | | | | | 0.27 |
| Detergency (%) | 70 | 70 | 70 | 30 | 35 |

Note:
[1]Respectively same as in Example 1.

EXAMPLE 3

Automated-Dishwashing Detergent Compositions

1) Washing Conditions

Same as in Example 1.

2) Plates Soiled With Cooked Rice And Method Of Evaluation

Soiled Plates

Cooked rice, freshly boiled to a soft consistency, is allowed to stand at room temperature for 30 minutes, then applied, with smashing, to ceramic plates having a diameter of 25 cm (3 g of cooked rice per plate), and dried for a whole day at room temperature. For each washing test run, 6 plates soiled in the above manner are used.

Evaluation Of Starchy Dirt Detergency

Same as in Example 1.

3) Detergent Composition Formulation

| | |
|---|---|
| SOFTANOL EP 7045 | 2.0 |
| Sodium tripolyphosphate | 20.0 |
| Sodium silicate, grade No. 1 | 5.0 |
| Enzyme | See Table 3 |
| Sodium carbonate | Balance |

Note:
The numerical values are in % by weight.

4) Detergency Test Results

The test results obtained are shown in Table 3, where Compositions Nos. 1 to 4 are of the present invention and Nos. 5 and 6 are for comparison.

TABLE 3

| | Composition No. | | | | | | | | | | |
|---|---|---|---|---|---|---|---|---|---|---|---|
| | 1 | 2 | 3 | 4 | 5* | 6* | 7 | 8 | 9 | 10 | 11 |
| Enzyme (Activity in units) | | | | | | | | | | | |
| SPLENTASE[1] | $2.6 \times 10^3$ | $3.2 \times 10^2$ | $2.6 \times 10^2$ | $1.6 \times 10^3$ | | | $2.6 \times 10^3$ | | | | |
| PROMOZYME[2] | | | | | | | | $5.5 \times 10^2$ | | $1.0 \times 10^2$ | |
| Isoamylase[3] | | | | | | | | | $1.1 \times 10^2$ | | $2.75 \times 10^3$ |
| TERMAMYL 300L[4] | $5.5 \times 10^2$ | $5.5 \times 10^2$ | $9.4 \times 10^2$ | $5.5 \times 10^2$ | $2.0 \times 10^3$ | | | $5.5 \times 10^2$ | $5.5 \times 10^2$ | | |
| MAXAMYL WL[5] | | | | | | $2.0 \times 10^3$ | $5.5 \times 10^2$ | | | $5.5 \times 10^2$ | $5.5 \times 10^2$ |
| Debranching enzyme/α-amylase activity ratio | 4.7 | 0.6 | 0.28 | 2.9 | — | — | 4.7 | 1.0 | 0.2 | 0.18 | 5.0 |
| Detergency | 85 | 85 | 85 | 87 | 20 | 35 | 88 | 85 | 73 | 85 | 85 |

Notes:
*Composition for comparison
[1]Pullulanase, Amano Pharmaceutical Co., Ltd.; $6.1 \times 10^6$ U/liter
[2]Pullulanase, Novo Industri A/S; $4.3 \times 10^5$ U/liter
[3]Isoamylase, Seikagaku Kogyo Co., Ltd.; $5.9 \times 10^7$ U/liter
[4]α-Amylase, Novo Industri A/S; $4.4 \times 10^7$ U/liter
[5]α-Amylase, Gist-Brocades; $7.2 \times 10^6$ U/liter

EXAMPLE 4

Laundry Detergent Compositions

The washing conditions and detergency test method used in this example and the results obtained are as follows:

1) Artificially Soiled Cloth

Cooked rice is two-fold diluted with tap water and subjected to blending in a mixer. The resulting mass is applied to cotton cloth testpieces having a size of 10 cm×10 cm to a weight increase of 2.5 to 5% based on the cloth weight, then dried at 20° C. for 24 hours and tested.

2) Washing Conditions And Method

Same as in Example 2.

3) Detergency Evaluation

Same as in Example 2.

4) Detergent Composition Formulation

| | |
|---|---|
| Sodium n-dodecylbenzenesulfonate | 15 |
| Sodium alkylethoxylate sulfate | 5 |

-continued

| | |
|---|---|
| ($C_{14}$-$C_{15}$, $\overline{EO}$ = 3 moles) | |
| Type 4A zeolite | 15 |
| Sodium silicate | 15 |
| Sodium carbonate | 15 |
| Sodium polyacrylate ($\overline{MW}$ = 8,000) | 1.5 |
| Polyethylene glycol ($\overline{MW}$ = 6,000) | 1.5 |
| Enzyme | See Table 4 |
| Optical brightener | 0.5 |
| Sodium sulfate | Balance |
| Water | 5 |

Note:
The numerical value are in % by weight.

5) Detergency Test Results

The test results obtained are shown in Table 4, where composition No. 1 is of the present invention and Composition No. 2 is for comparison.

TABLE 4

| | Composition No. | |
|---|---|---|
| Enzyme | 1 | 2 |
| SPLENTASE[1] | $3.2 \times 10^2$ | — |
| TERMAMYL 300L[1] | $5.5 \times 10^2$ | $2.0 \times 10^3$ |
| Activity ratio | 0.6 | — |
| Detergency (%) | 80 | 30 |

Note:
The numerical values given for the enzymes indicate the activities in units per liter of washing solution.

EXAMPLE 5

Automatic-Dishwashing Detergent Compositions

1) Washing Conditions

Same as in Example 1.

2) Detergency Evaluation

(1) Fat-Soiled Plates And Method Of Evaluation

Soiled Plates

Beef tallow (5 g) is applied to each of ceramic plates (25 cm in diameter) and air-dried for a whole day. For each test run, 2 plates are used.

Evaluation For Fatty Dirt Detergency

After washing, an Oil Red solution is poured onto each plate. The thus-colored area ($S_1$) on the plate surface is measured by a photograph and compared with the initial soiled area ($S_0$). The detergency is thus calculated by the following equation:

$$\text{Detergency } (\%) = ((S_0 - S_1)/S_0) \times 100$$

(2) Rice-Soiled Plates And Method Of Evaluation

Soiled Plates

Same as in Example 3.

Evaluation Of Starchy Dirt Detergency

Same as in Example 1.

The compositions specified in Table 5 below were prepared and evaluated for detergency by the above-mentioned methods of evaluation. The results obtained are also shown in Table 5.

In Table 5, Compositions Nos. 1 and 2 are for comparison, while the other compositions fall within the scope of the present invention. From the data shown in Table 5, it is apparent that the combined use of the components (a), (b) and (c) of the present invention can produce a significant synergistic effect.

TABLE 5

| | Composition No. | | | | | | |
|---|---|---|---|---|---|---|---|
| Component | 1 | 2 | 3 | 4 | 5 | 6 | 7 |
| (a) SOFTANOL EP 7045 | 2 | 2 | 2 | 2 | 2 | 2 | 2 |
| (b) SPLENTASE[1] | | | 0.67 | 0.75 | 0.95 | 0.975 | |
| PROMOZYME[2] | | | | | | | |
| Isoamylase[3] | | | | | | | 0.01 |
| (c) TERMAMYL 300L[4] | 1 | | 0.33 | 0.25 | 0.05 | 0.025 | |
| MAXAMYL WL[5] | | 1 | | | | | 0.99 |
| (d) Sodium citrate | | 20 | 20 | 20 | 20 | 20 | 20 |
| Sodium tartrate | | | | | | | 20 |
| Potassium malate | | | | | | | |
| (e) Sodium carbonate | B[6] | B | B | B | B | B | B |
| Sodium silicate No. 1 | 5 | 5 | 5 | 5 | 5 | 5 | 5 |
| Sodium polyacrylate ($\overline{MW}$6000) | | | | | | | |
| Acrylic acid/methacrylic acid copolymer (mole ratio 90/10, $\overline{MW}$8000) | | | | | | | |
| (b)/(c) activity ratio | — | — | 0.26 | 0.6 | 3 | 6 | 5 |
| Rice dirt detergency | 20 | 20 | 100 | 100 | 100 | 100 | 100 |
| Fatty dirt detergency | 50 | 80 | 80 | 80 | 80 | 80 | 80 |

| | Composition No. | | | | | |
|---|---|---|---|---|---|---|
| Component | 8 | 9 | 10 | 11 | 12 | 13 |
| (a) SOFTANOL EP 7045 | 2 | 2 | 2 | 2 | 2 | 2 |
| (b) SPLENTASE[1] | 0.991 | | | | 0.75 | 0.75 |
| PROMOZYME[2] | | 0.998 | 0.99 | | | |
| Isoamylase[3] | | | | 0.74 | | |
| (c) TERMAMYL 300L[4] | | | 0.01 | 0.26 | 0.25 | 0.25 |
| MAXAMYL WL[5] | 0.009 | 0.002 | | | | |
| (d) Sodium citrate | | 20 | | | 20 | 20 |
| Sodium tartrate | | | 20 | | | |
| Potassium malate | 20 | | | 20 | | |
| (e) Sodium carbonate | B | B | B | B | B | B |
| Sodium silicate No. 1 | 5 | 5 | 5 | | 5 | 5 |
| Sodium polyacrylate ($\overline{MW}$6000) | | | | | 5 | |
| Acrylic acid/methacrylic acid copolymer (mole ratio 90/10, $\overline{MW}$8000) | | | | | | 5 |

TABLE 5-continued

| | | | | | | |
|---|---|---|---|---|---|---|
| (b)/(c) activity ratio | 10 | 40 | 1 | 0.2 | 0.6 | 0.6 |
| Rice dirt detergency | 100 | 100 | 100 | 100 | 100 | 100 |
| Fatty dirt detergency | 80 | 80 | 80 | 80 | 90 | 90 |

Notes:
[1]Amano Pharmaceutical Co., Ltd., $6.1 \times 10^4$ U/liter
[2]Novo Industri A/S, $4.3 \times 10^5$ U/liter
[3]Seikagaku Kogyo Co., Ltd., $5.9 \times 10^7$ U/liter
[4]Novo Industri A/S, $4.4 \times 10^7$ U/liter;
[5]Gist-Brocades, $7.2 \times 10^6$ U/liter;
[6]B stands for "balance".

While the invention has been described in detail and with reference to specific embodiments thereof, it will be apparent to one skilled in the art that various changes and modifications can be made therein without departing from the spirit and scope thereof.

What is claimed is:

1. A detergent composition which comprises (a) at least one surfactant in an amount of 0.5–60% by weight and (b) at least one starch debranching enzyme in an amount of 0.01–10% by weight and selected from the group consisting of pullulanase, isopullulanase and isoamylase.

2. A detergent composition as claimed in claim 1, wherein said composition further contains α-amylase the total content of the starch debranching enzyme and α-amalase being 0.1–10% by weight.

3. A detergent composition as claimed in claim 2, wherein said starch debranching enzyme and said α-amylase are contained in an amount to satisfy the relation such that an activity ratio of said starch debranching enzyme and said α-amylase is $1/10^3$ to $1/10^8$, as determined by the DNS method.

4. A detergent composition as claimed in claim 3, wherein said starch debranching enzyme and said α-amylase are contained in an amount to satisfy the relation such that an activity ratio of said starch debranching enzyme and said α-amylase is 1/10 to $1/10^2$, as determined by the DNS method.

5. A detergent composition as claimed in claim 2, wherein the surfactant content is 0.5–30% by weight, the total content of the starch debranching enzyme and α-amylase is 0.1–5% by weight and wherein said detergent composition further contains a hydroxypolycarboxylic acid or a salt thereof in an amount of 0.5–30% by weight.

6. A method for cleaning soiled dishware, which comprises the step of contacting the soiled dishware in an automatic dishwashing machine with an aqueous solution containing an effective amount of the detergent composition of claim 1.

7. A method for cleaning soiled dishware, which comprises the step of contacting the soiled dishware in an automatic dishwashing machine with an aqueous solution containing an effective amount of the detergent composition of claim 2.

8. A method for cleaning soiled cloth, which comprises the step of contacting the soiled cloth with an aqueous solution containing an effective amount of the detergent composition of claim 1.

9. A method for cleaning soiled cloth, which comprises the step of contacting the soiled cloth with an aqueous solution containing an effective amount of the detergent composition of claim 2.

* * * * *